United States Patent [19]

Morooka et al.

[11] 4,003,230

[45] Jan. 18, 1977

[54] TENSION CONTROL SYSTEM FOR UNIVERSAL MILL

[75] Inventors: Yasuo Morooka; Shinya Tanifuji, both of Hitachi, Japan

[73] Assignee: Hitachi, Ltd., Japan

[22] Filed: Aug. 15, 1975

[21] Appl. No.: 604,951

[30] Foreign Application Priority Data

Aug. 16, 1974 Japan ..... 49-93363

[52] U.S. Cl. ..... 72/19; 72/205

[51] Int. Cl.[2] ..... B21B 37/08; B21B 37/00

[58] Field of Search ..... 72/6, 8, 19, 7, 9–12, 72/225, 205, 234

[56] References Cited

UNITED STATES PATENTS 3,457,747 7/1969 Yeomans ..... 72/19

3,650,135 3/1972 Shelton et al. ..... 72/8

3,807,208 4/1974 Hensleigh ..... 72/19

*Primary Examiner*—Milton S. Mehr

*Attorney, Agent, or Firm*—Craig & Antonelli

[57] ABSTRACT

A tension control system for use with a universal mill such as an H beam mill, in which a tension force in a billet, to be rolled, between roll stands is controlled so as to be maintained at zero. Providing that effective loads (Pu) are obtained by linearly summing horizontal and vertical rolling loads, the tension control system controls roll driving motors so as to maintain the respective ratios T/Pu of rolling torques T to effective loads (Pu) constant, thereby performing a non-tension control.

14 Claims, 5 Drawing Figures

TENSION CONTROL SYSTEM FOR UNIVERSAL MILL

BACKGROUND OF THE INVENTION

This invention relates to a tension control system for use in performing a non-tension control in rolling shaped steel. In rolling shaped steel such as an H beam, there has been recently proposed a non-tension control, and the theories for the non-tension control have been developed in the field of plate rolling.

Figure 1:
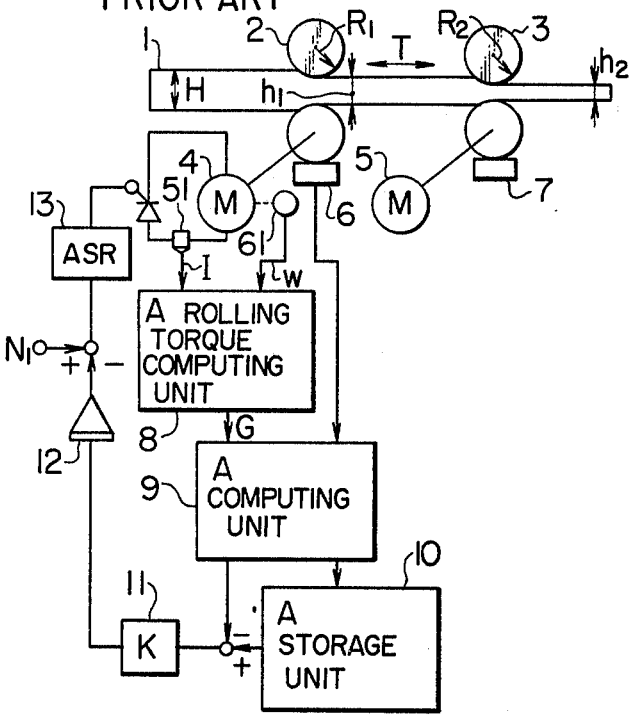
FIG. 1 PRIOR ART
FIG. 1 is a block diagram of a non-tension control for plate rolling in continuous rolling mills consisting of two stands.

Description will be given in more detail of the non-tension control for plate rolling with reference to two-stands continuous rolling mill shown in FIG. 1.

In the drawing, the reference numeral 1 designates a billet, 2 a first stand rolling mill, 3 a second stand rolling mill, 4 a drive electric motor for the first stand rolling mill, 5 a drive electric motor for the second stand rolling mill, 6 and 7 load cells, 8 a rolling torque computing unit, 9 a computing unit which receives a rolling torque from the unit 8 and a rolling load from the load cell 6 as inputs and computes the ratio thereof, 10 a storage unit for storing the ratio of a rolling torque to a rolling load which rolling torque is measured, before the billet 1 is locked on in the second stand rolling mill, 11 a gain multiplying unit, 12 an integrating unit, and 13 a speed control unit. N1 is a reference speed of the first stand rolling mill 2.

The rolling-torque computing unit 8 computes a rolling torque G according to the following formula;

$$G = \frac{IV}{\omega} - J \cdot \frac{d\omega}{dt} - G_{LOSS}$$

wherein $I$: an output from a current detector 51, $\omega$: an angular velocity from a speed detector 61, $V$: a terminal voltage of an electric motor 41

$J$: moment of inertia of an electric motor, and $G_{LOSS}$: a loss torque of an electric motor.

In FIG. 1, a tension T is produced in the billet between the two stands rolling mills, and then torque G1 in the first stand rolling mill 2 can be expressed by using a rolling load P1 and a roll radius R1 as follows:

$$G1 = 2l_1 P1 - R1T \quad (1)$$

wherein $l_1$ is a torque arm. The formula (1) is modified as follows:

$$\frac{R1}{P1} T = 2l_1 - \frac{G1}{P1} \quad (2)$$

If a torque arm in the first term of the right side is scarcely varied by disturbance, then a torque arm may be substituted by a torque arm under the condition of non-tension. A torque arm under the condition of non-tension may be obtained by assuming $T = 0$ in the formula and using only a rolling torque and a rolling load. Accordingly, the formula (3) holds in which each of the various values are accompanied by a suffix 0 to represent the condition of non-tension.

$$2l_1 \approx 2l_{10} = \left(\frac{G1}{P1}\right)_o \quad (3)$$

By substituting the formula (3) for the first term of the right side in the formula (2), the formula (4) may be given as follows:

$$\frac{R1}{P1} T = \left(\frac{G1}{P1}\right)_o - \left(\frac{G1}{P1}\right) \quad (4)$$

Accordingly, in order to achieve the non-tension rolling when the billet 1 is being rolled in the first and second stand rolling mills 2, 3, the speed control should be effected such that the ratio of the rolling torque to the rolling load in the first stand rolling mill 2 be equal to the value of the ratio $(G1/P1)_o$ which value exists before the billet is locked on in the second stand rolling mill 3.

More specifically, the speed control of the first stand drive motor should be effected by means of the speed control unit 13 so as to nullify the difference between the value $(G1/P1)_o$ stored in the storage unit 10 and the value (G1/P1) obtained from the computing unit 9.

However, the non-tension control as used in an ordinary plate rolling can not be intact applied to rolling H beams by a universal rolling mill.

Figure 2:
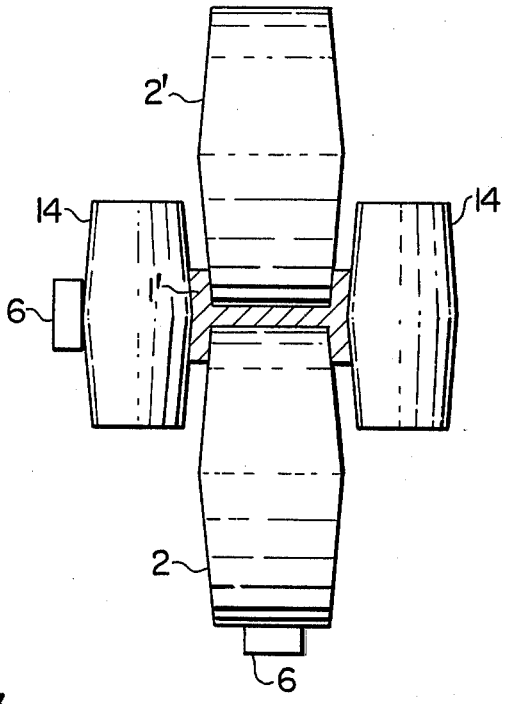
FIG. 2 is a diagrammatic view showing the principle of H-beam rolling in a universal rolling mill.

With a universal rolling mill shown in FIG. 2, vertical rolls 14 are usually of non-driven type, so that the entire rolling torque is given by a single horizontal-roll driving electric motor. Rolling loads are detected by means of the load cells 6 from both the horizontal roll 2 and the vertical rolls 14. In case of plate rolling, the formula (1) holds between a rolling torque and rolling load. In contrast thereto, in case of H beam rolling, there are present a horizontal rolling load and a vertical rolling load, and the relations between those rolling loads and the rolling torque are unknown, so that the formula (4) can not be used for the tension control. The principle of the non-tension control is based on the ratio of a rolling torque to a rolling load. Accordingly, the aforesaid drawback has been an substantial obstacle to be overcome in achieving the non-tension control for rolling of H beams.

In the tension control system described above, it is assumed that the torque arm $l_1$ is scarcely affected by disturbance. However, the torque arm may be varied due to a thermal run down, a skid mark and the like in the billet. In this respect, a tension created by those factors described above can not be removed by resorting to the non-tension control. The tension due to the thermal run down presents a problem in causing a variation in width of a billet.

SUMMARY OF THE INVENTION

The present invention is directed to eliminating the aforesaid drawbacks, and it is an object thereof to provide a tension control system for use in rolling H beams with high accuracy.

It is another object of the present invention to provide a tension control system adapted for the standardization of computing units.

The feature of the tension control system according to the present invention is to use a horizontal rolling load, vertical rolling load and torque of a drive electric motor in a universal rolling mill as inputs for tension control.

These and other objects and features of the present invention will be apparent from the following description.

In order to assist understanding of the present invention, the principle and validity thereof will be briefly given hereinafter.

The principle incorporated in the present invention is that an effective rolling load P*u* is obtained by linearlly summing or coupling a rolling load P*h* of the horizontal rolls and a rolling load Pv of the vertical rolls, and the effective rolling load P*u* thus obtained is regarded as corresponding to a rolling load in plate rolling. More specifically, assume the following formula:

$$Pu = P_H + \alpha P_V \quad (5)$$

Then, the rolling torque for rolling H beams in the universal rolling mill is given as follows:

$$G_U = 2\ lwPu - R_H T_M \quad (6),$$

wherein $G_U$ represents a rolling torque.

$$T_M = T \cdot Q_r \quad (7),$$

wherein

*T* represents the entire tension force acting on the cross section of H beam, $Q_r$: shape-correction coefficient, and

*lw*: web torque arm in a universal rolling mill.

As can be seen from the formula (7), T is brought to zero by bringing the tension $T_M$ to zero.

The formula (6) is of the same form as that of the formula (1), so that the non-tension control may be carried out in the same line of thinking as in the case of plate rolling.

Examination will be given to the validity of the aforesaid formula (5) representing the linear sum or coupling of P*u* and P*v*. Firstly, the formula (5) is substituted for P*u* in the formula (6) to thereby obtain formulae (8) and (9).

$$G_U = 2lw\ (P_H + \alpha P_V) - R_H \cdot T_M \quad (8)$$

Accordingly, $$(G_U + R_H T_M)/2lwP_V = P_H/P_V + \alpha \quad (9)$$

From the formulae (8) and (9), there must be maintained a linear relation between $G_U/2lwP_V$ and $P_H/P_V$ in the absence of the tension.

Figure 3:
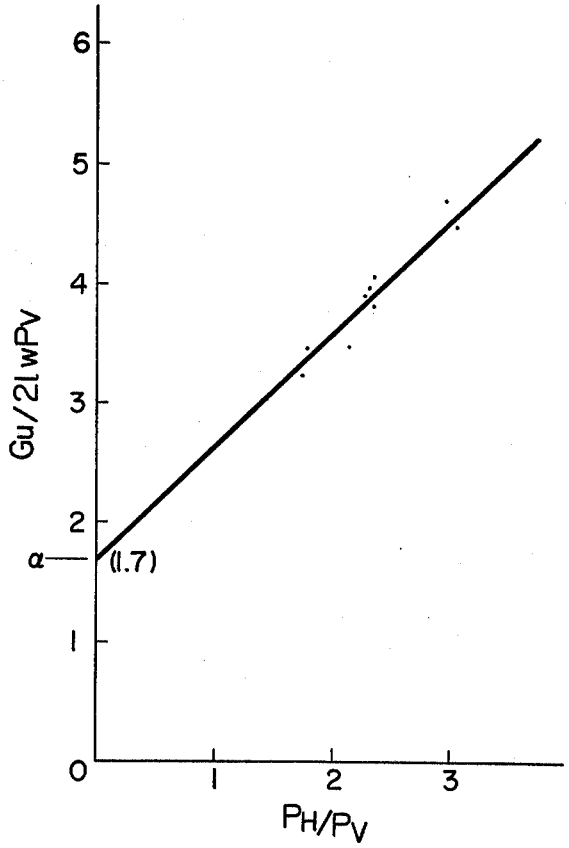
FIG. 3 is a graph showing the relationship between (Gu/2glwPv) and ($P_H/P_V$) obtained from the data in the actual operation.
Figure 4:
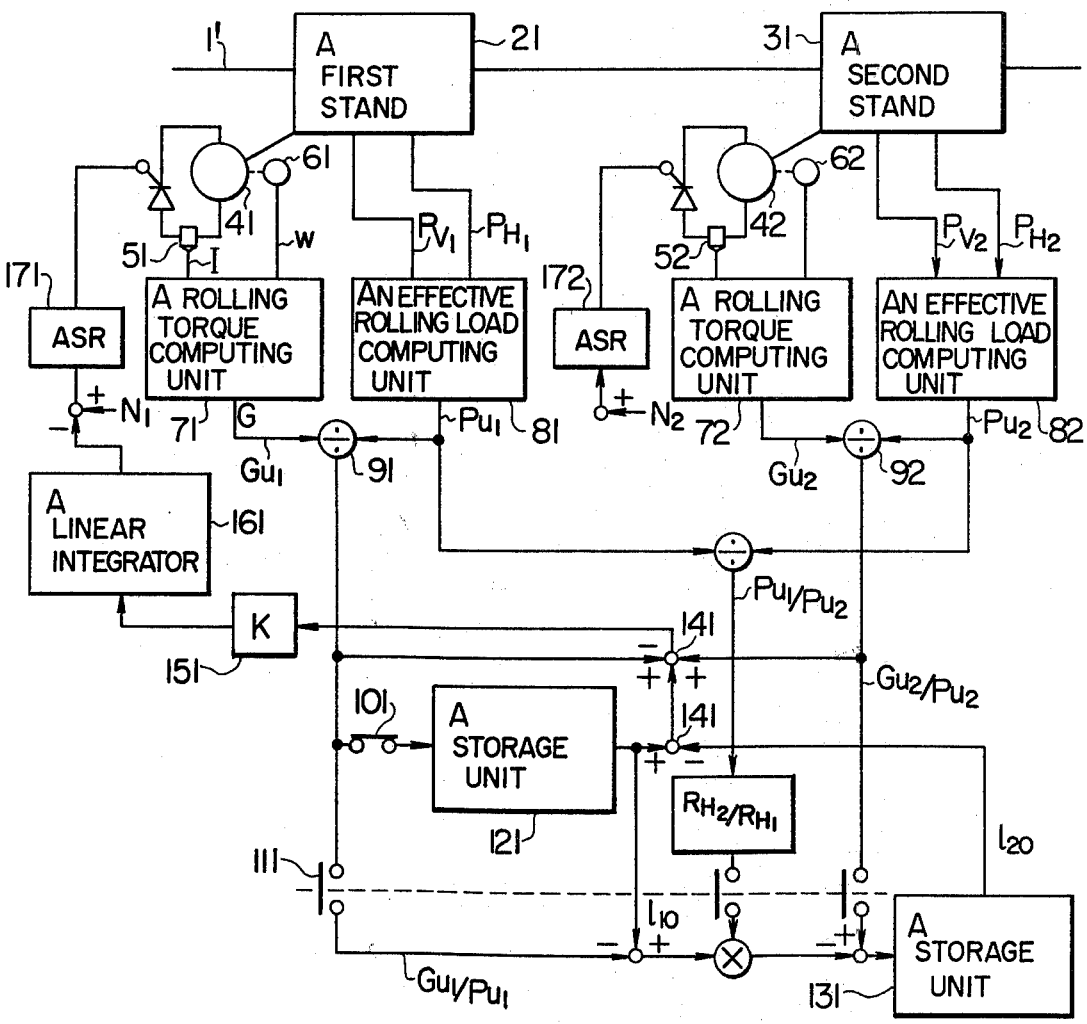
FIG. 4 is a block diagram showing one embodiment in which a tension control system for H beams is applied to H beam continuous rolling by two universal rolling mills.

FIG. 3 is a graph showing the relation between $G_U/2lwP_V$ and $P_H/P_V$ which has been obtained from data of the actual operation in rolling H beams. From this graph, the following formula is established:

$$G_U/2lwP_V = P_H/P_V + 1.7 \quad (10)$$

As can be seen from the above formula (10), the linear relation holds between $G_U/2lwP_V$ and $P_H/P_V$. Accordingly, the assumption in the form of the formula (5) holds good. Furthermore, according to a work diagram, it is found that the value of a constant $\alpha$ should be determined as 1.7.

The constant $\alpha$ may be obtained from the calculation to be described hereinbelow. The rolling torque in the non-tension condition in rolling H beams can be approximately obtained from the formula (11) by using horizontal and vertical rolling loads $P_H$ and $P_V$, a web portion torque arm *lw*, and a flange portion torque arm $l_F$:

$$G_U = 2lwP_H + \frac{R_H}{R_V} \cdot 2l_F P_V \quad (11)$$

$$= 2lw\left(P_H + \frac{R_V}{R_H} \cdot \frac{l_F}{lw} P_V\right) \quad (12)$$

wherein $R_H$ represents a radius of a horizontal roll and $R_V$ represents a radius of a vertical roll. In comparing the formula (12) with the formula (8), it is seen that the formula (13) holds good.

$$\alpha = \frac{R_H}{R_V} \cdot \frac{l_F}{lw} \quad (13)$$

Here, the following two formulae holds good as to the geometric relations of the rolling mill.

$$lw = \sqrt{R'_H\ \Delta\ hw}$$

$$l_F = \sqrt{2R'_V\ \Delta\ h_F},$$

wherein $R'_H$: deformed roll radius of a horizontal roll.

$R'_V$: deformed role radius of a vertical roll.

$\Delta hw$: draft of web.

$\Delta h_F$: draft of flange.

Accordingly, in case the flatness rates of the horizontal and vertical rolls, respectively, are substantially the same to each other or in case the flatness rates may be neglected, $\alpha$ can be given in the following formula:

$$\alpha \approx \sqrt{\frac{2R_H\ \Delta\ h_F}{R_V\ \Delta\ hw}} \quad (14)$$

When $\alpha$ is calculated according to the same work diagram as that of the actual operation shown in FIG. 3, then $\alpha = 1.75$.

The principle will be described hereinbelow, in which the non-tension control is carried out in the universal rolling mills of two stands by using the relation between a rolling torque and an effective rolling load. Hereinafter, the data in association with the *i*th stand will be indicated by a suffix *i*, the data in the condition immediately after a billet has been locked on in the *i*th stand will be indicated by a suffix B and, the date in the non-tension condition will be indicated by suffixes 0.

The torque when a tension force T develops in the billet between the both stands, is expressed in the following formulae (15) and (16) derived from the formula (8):

$$G_{U1}\ 1 = 2l_1\ P_{U1} - R_{H1}\ T_M \quad (15)$$

$$G_{U2} = 2l_2\ P_{U2} + R_{H2}\ T_M \quad (16)$$

$$T_M = T \cdot Q_T \quad (17)$$

The formulae (15) and (16) are modified to provide a formula (18):

$$\left(\frac{R_1}{P_1} + \frac{R_2}{P_2}\right) T_M = (2l_1 - 2l_2) - \left(\frac{G_1}{P_1} - \frac{G_2}{P_2}\right) \quad (18)$$

The torque arms included in the first parenthesis on the right side is scarcely varied due to tension force and the like. In case the torque arms are varied due to the variation in thermal run down temperature, the variations are considered to be on the same order with respect to $l_1$ and $l_2$, so that there is no variation in the difference between the torque arms. Accordingly, the first parenthesis on the right side may be substituted by the difference in the torque arms in the non-tension condition. That is, $$\left(\frac{R_1}{P_{U1}} + \frac{R_2}{P_{U2}}\right) T_M = (2l_{10} - 2l_{20}) - \left(\frac{G_1}{P_1} - \frac{G_2}{P_2}\right) \quad (19)$$

The torque arm $l_{10}$ in the formula (19) may be given in the condition before a billet is locked on in the second stand, so that when $T_M = 0$ in the formula (15), the following formula is given:

$$2l_{10} = \left(\frac{G_{U1}}{P_{U1}}\right)_o \quad (20)$$

$T_M$ is eliminated from the formulae (15) and (16), and then 2 $l_{2B}$ immediately after the billet has been locked on in the second stand is obtained:

$$2l_{2B} = \left(\frac{G_{U2}}{P_{U2}}\right)_B - \frac{R_{H2}}{R_{H1}} \cdot \left(\frac{P_{U1}}{P_{U2}}\right)_B \left\{2l_{1B} - \left(\frac{G_{U1}}{P_{U1}}\right)_B\right\} \quad (21)$$

Since it is recognized that a torque arm obtained immediately after the billet has been locked on in a stand, is substantially equal to a torque arm in the non-tension condition immediately before the billet is locked on in a stand, the torque arm in the second stand in the non-tension condition is determined by the formula (22):

$$2l_{20} \approx 2l_{2B}$$

$$= \left(\frac{G_{U2}}{P_{U2}}\right)_B - \frac{R_{H2}}{R_{H1}} \left(\frac{P_{U1}}{P_{U2}}\right)_B \left\{\left(\frac{G_{U1}}{P_{U1}}\right) - \left(\frac{G_{U1}}{P_{U1}}\right)_B\right\} \quad (22)$$

As can be seen from this, the difference in the torque arms in the non-tension condition, which difference is represented in the first parenthesis of the right side of the formula (19), can be calculated by using the formulae (20) and (22). The resulting value holds good until immediately after the billet has been locked on in the second stand. After the calculation, the difference between the first and second parentheses on the right side of the formula (19) can be evaluated by calculating the second parenthesis on the right side of the formula (19). Then, by feeding the resulting value of the difference to an electric motor speed control system for either of the roll stands, the tension control can be achieved.

DESCRIPTION OF THE PREFERRED EMBODIMENTS

Description will now be given of one embodiment in which the principle of the present invention is applied to continuous rolling by two universal rolling mills.

With reference to the drawings, parts similar to those in FIG. 1 are designated by like reference numerals. The reference numeral 1' designates a billet for H beam, 21, 31 first and second rolling stands in a universal rolling mill, and 41, 42 DC electric motors for driving horizontal rolls, respectively. The numerals 71 and 72 designate torque computing units which receive the outputs from current detectors 51, 52 and speed detectors 61, 62 together with voltage detecting values (not shown) as inputs thereof to thereby compute a rolling torque $G_U$ by using the formula (1). Effective rolling load computing units 81, 82 receive horizontal and vertical rolling loads $P_H$ and $P_V$, which have been detected by means of load cells (not shown), to thereby calculate an effective rolling load for H beam by using the formulae (5) and (14). Dividers 91, 92 calculate the respective ratios of outputs of rolling torque computing units 71, 72 to outputs of effective rolling load computing units 81, 82, respectively. A one shot relay 101 is adapted to be actuated before the billet 1 is locked on in the second stand and, one shot relay 111 adapted to be actuated in cooperation immediately after the billet 1 has been locked on in the second stand. A storage unit 121 serves to store an output of the divider 91 which output amounts to a value in non-tension condition of the first stand. A storage unit 131 serves to store a torque arm in the non-tension condition in the second stand. An adder 141 serves to calculate a value given on the right side of the formula (19) from the outputs of the dividers 91, 92 and storage units 121, 131 in the respective stands. A gain unit 151 serves to convert the output of the adder 141 in dimension of speed. The numeral 161 designates a linear integration control unit, and 171 a speed control unit for a horizontal-roll driving electric motor.

In operation, whenever the billet 1 continues to be locked on in the first stand 21, the computing unit 81 computes an effective rolling load $P_{U1}$ from the detected values of horizontal and vertical rolling loads $P_{H1}$ and P*vl* in a manner to be described hereinafter. Simultaneously, the computing unit 71 calculates a rolling torque G*ul* from current, voltage and R.P.M. of the horizontal roll driving electric motor 41. Then, the divider 91 calculates the ratio (*Gul/Pul*) from these values P*ul* and G*ul*. The billet 1 is detected before being locked on in the second stand 31 to cause the one shot relay 101 to be actuated, so that the output of divider 91 is stored in the storage unit 121 as a torque arm $l_{10}$ of the first stand. Also, immediately after the billet 1 has been locked on in the second stand 31, the one shot relay 111 is caused to be actuated, so that the difference between the outputs of the divider 91 and the storage unit 121 can be obtained, and then the value of the difference is multiplied by $R_{H2}/R_{H1}$ and an effective rolling load ratio $(P_{U1}/P_{U2})_B$, then, the value thus obtained is subtracted from the output of the divider 92 according to the formula (22). Then, the value thus obtained is stored in the storage unit 131 as a torque arm in case of the non-tension condition. Thereafter, the right side of the formula (19) is calculated by means of the adder 141 from the outputs of dividers 91, 92 and storage units 121, 131, and then the value thus obtained is multiplied by a gain in the gain unit 151 for obtaining the speed variation ΔN/N. In other words, the speed variation is given in the following formula:

$$\frac{\Delta N}{N} = K\left\{(2l_{10} - 2l_{20}) - \left(\frac{G_{1U}}{P_{1U}} - \frac{G_{2U}}{P_{2U}}\right)\right\} \qquad (23)$$

Then, the speed variation is fed through the linear integrator 161 into a speed commanding unit 171 for the first stand 1 for compensating for the stability and adaptability of the system. In this manner, the non-tension control can be achieved.

Figure 5:
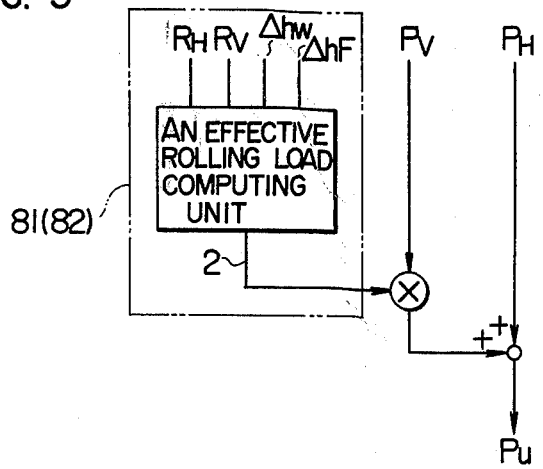
FIG. 5 is a block diagram for computing units adapted to calculate effective rolling load in H beam rolling by universal rolling mills.

FIG. 5 is a detailed view of the effective rolling load computing units 81, 82 for H beam in universal rolling. The computing units 81, 82 receive drafts ($\Delta hw$, $\Delta h_F$) of web and flange, a horizontal roll radius $R_H$, and a vertical roll radius $R_V$ to calculate a constant $\alpha$, and in addition receive the rolling loads $P_H$ and $P_V$ to calculate the effective rolling load ($P_H + \alpha P_V$). Here, it is to be understood that in case the value $\alpha$ is known from the data of actual operation, $\alpha$ can be set up without resorting to the calculation thereof by the formula (14).

As is apparent from the foregoing, the present invention provides a novel and effective tension control system for rolling shape steel in a plurality of universal rolling mills. More specifically, there is provided an accurate tension control system for rolling shape steel which system employs horizontal and vertical rolling loads in addition to torques of driving motors as inputs of the system. Heretofore, such tension control system has not been established for shape steel.

In addition, the feature of the present invention resides in that by substituting the effective rolling load $P_V$ for two rolling laods $P_H$ and $P_V$, the tension control for rolling H beam can be carried out in the same manner as in the tension control for rolling plates.

Accordingly, almost the same system as the tension control system for plate rolling can be used for rolling shape steel, thus contributing to the standardization of the system.

What is claimed is:

1. A tension control system for use in a continuous rolling mill system comprising a plurality of rolling mills each having horizontal and vertical rolls for simultaneously applying rolling loads on the same section of a billet to be rolled, electric motor means for driving said rolls, means for determining the horizontal and vertical rolling loads, means for determining the rolling torques of said electric motor means, and means for controlling the rotational speed of said electric motor means in dependence on the horizontal and vertical rolling loads and rolling torque of said electric motor means.

2. A tension control system according to claim 1, wherein said means for controlling includes means for providing a linear sum of the horizontal and vertical rolling loads, the linear sum and rolling torque of the electric motor means being utilized for tension control.

3. A tension control system according to claim 2, wherein the linear sum of the horizontal and vertical rolling loads includes a coefficient having a value determined by the respective roll radii of said horizontal and vertical rolls.

4. A tension control system according to claim 2, wherein the linear sum of the horizontal and vertical rolling loads includes a coefficient having a value determined by the respective drafts of web and flange.

5. A tension control system according to claim 1, wherein said means for controlling the rotational speed of said electric motor means control the rotational speed such that the ratio T/P*u* is maintained constant, wherein P*u* is the linear sum of the horizontal and vertical rolling loads and T is the rolling torque of the electric motor means.

6. A tension control system according to claim 5, wherein the linear sum of the horizontal and vertical rolling loads includes a coefficient having a value determined by the respective roll radii of said horizontal and vertical rolls.

7. A tension control system according to claim 5, wherein the linear sum of the horizontal and vertical rolling loads includes a coefficient having a value determined by the respective drafts of web and flange.

8. A tension control system according to claim 1, wherein said electric motor means includes an electric motor for each respective rolling mill, said electric motor driving the horizontal rolls of the associated rolling mill.

9. A tension control system according to claim 8, wherein said means for controlling is responsive at least to the horizontal and vertical rolling loads and the rolling torque of said electric motor of a respective rolling mill.

10. A tension control system for use in a continuous rolling mill system comprising a plurality of rolling mills each having horizontal and vertical rolls for simultaneously applying rolling loads on the same section of a billet to be rolled, electric motor means for driving said rolls, means for determining the horizontal and vertical rolling loads, means for determining the rolling torque of said electric motor means, means for providing a linear sum of the horizontal and vertical rolling loads, and means for controlling the rotational speed of said electric motor means such that the relationship between the linear sum of the horizontal and vertical rolling loads, and rolling torque of said electric motor means is maintained constant, said horizontal and vertical rolling loads being determined when the billet is locked on in a predetermined rolling mill stand.

11. A tension control system according to claim 10, wherein the linear sum of the horizontal and vertical rolling loads includes a coefficient having a value determined by the respective drafts of web and flange.

12. A tension control system according to claim 10, wherein the linear sum of the horizontal load and vertical rolling loads includes a coefficient having a value determined by the respective roll radii of said horizontal and vertical rolls.

13. A tension control system according to claim 10, wherein said electric motor means includes an electric motor for each respective rolling mill, said electric motor driving the horizontal rolls of the associated rolling mill.

14. A tension control system according to claim 13, wherein said means for controlling is responsive at least to the horizontal and vertical rolling loads and the rolling torque of said electric motor of a respective rolling mill.

* * * * *